United States Patent [19]

Ikonomou

[11] 4,166,344

[45] Sep. 4, 1979

[54] EARTHQUAKE GUARDING SYSTEM

[76] Inventor: Aristarchos S. Ikonomou, Evrovstr. 90, Athens 609, Greece

[21] Appl. No.: 783,310

[22] Filed: Mar. 31, 1977

Related U.S. Application Data

[63] Continuation of Ser. No. 399,175, Sep. 20, 1973, abandoned.

[30] Foreign Application Priority Data

Sep. 21, 1972 [GR] Greece ..... 45907

[51] Int. Cl.[2] ..... E02D 27/34

[52] U.S. Cl. ..... 52/167

[58] Field of Search ..... 52/167

[56] References Cited

U.S. PATENT DOCUMENTS

| | | | |
|---|---|---|---|
| 3,638,377 | 2/1972 | Caspe | 52/167 |
| 3,794,277 | 2/1974 | Smedley et al. | 52/167 X |

FOREIGN PATENT DOCUMENTS

| | | | |
|---|---|---|---|
| 901031 | 5/1972 | Canada | 52/167 |

*Primary Examiner*—Carl D. Friedman

*Attorney, Agent, or Firm*—Cushman, Darby & Cushman

[57] ABSTRACT

An earthquake - resistant structure that permits limited displacement between the structure and the ground, comprising support means and connecting means. The support means provides elastic resistance to movement of the structure and the connecting means provides a frangible link between the structure and the ground, breaking when the earthquake reaches a predetermined strength.

20 Claims, 4 Drawing Figures

EARTHQUAKE GUARDING SYSTEM

This is a continuation of my application Ser. No. 399,175, filed Sept. 20, 1973, now abandoned.

This invention relates to a completely new earthquake guarding system adapted to protect buildings, bridges and other large structures against the worst damages of earthquakes. To achieve protection against destructive earth tremors, replaceable guard bars are positioned to provide an adjustable support between the earth and the structure being supported thereon. The guard bars are spaced laterally between the earth and the structure which may be a building or a bridge, for example. The guard bars are so proportioned as to break when the intensity of an earthquake exceeds a predetermined minimum strength. In addition, a form of earthquake guard supports are provided that are adapted to transmit seismic vibrations in a manner similar to a shock absorber in a large machine. Further, there are provided earthquake guard discs that are particularly adapted to provide horizontal joints for vertical building structures or columns.

It is a general object of the present invention to provide a greatly improved system for protecting buildings, bridges, and other structures against excessive damages from earthquakes.

It is another object of the invention to provide laminated plates to afford protection against the transmission of excessive seismic vibrations by functioning in a manner analogous to a shock absorber in a large machine.

A still further object of the invention is to provide protection against destructive earth tremors by providing replaceable guard bars adapted to break to protect large structures against transmission of excessive vibration.

Yet another object of the invention is to provide a structure having a superstructure and at least one load distributing base supporting said superstructure, the connections between said structure and the earth being essentially a support means and a connecting means said support means transferring to the ground the load of the structure in a first direction from said load distributing base, said support means providing elastic resistance to movement of the structure in all directions perpendicular to said first direction so that said support means is able to follow dynamic movement of the ground in said perpendicular directions without transferring great forces from the ground to said base in said perpendicular directions, said structure being provided with peripheral clearance from the ground in said perpendicular directions so that said base can move a predetermined distance through said clearance relative to the ground in said perpendicular directions, said connecting means being connected respectively to said base and to the ground in a said perpendicular direction, said connecting means being sufficiently strong to substantially prevent movement of said structure under forces in said perpendicular directions less than a predetermined magnitude but sufficiently weak to abruptly disconnect the connection between the ground and the base immediately upon being subject to a force of said predetermined magnitude when said base was moved a small proportion of said predetermined distance in said perpendicular direction, thereby removing the restraint against movement of the structure in said perpendicular direction by removing the transmission of forces in said perpendicular direction through said connecting means so that the structure remains connected to the ground essentially only by said support means, said support means having sufficient elastic stiffness in said perpendicular direction to apply restoring forces to said structure and to safely transfer loads in said perpendicular direction from the structure to the ground, after said connecting means has disconnected, thereby permitting the structure to move relative to the ground in said perpendicular direction through said peripheral clearance against the elastic resistance of said support means and in accordance with abruptly changed dynamic characteristics and to withstand said dynamic movements of the ground.

Various features and advantages of the present invention will become more apparent from the following detailed description of a preferred embodiment shown in the accompanying drawings in which.

The essential characteristic of the invention is that the buildings are seated upon a massive plate of concrete, preferably prestressed concrete, referred to herein as the disc, which plate is supported on the ground by way of elastic bearings. The plate is anchored with respect to the ground by means of these rods, which are of such dimension that normal horizontal loads, for example due to winds on tall buildings, or braking forces on bridges, can be transferred to the ground, but forces of the magnitude such as arise from jolts caused by earthquakes result in that the rods tear or break at a certain location so that the ground can effect horizontal movements with respect to the particular building.

Figure 3:
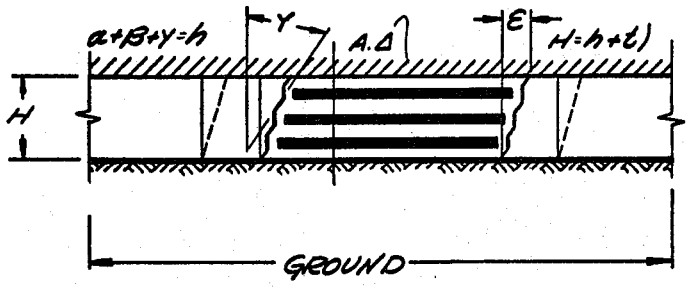
FIG. 3 is a cross-section through a support along lines 3—3 of FIG. 1 showing the support in deformed condition when the structure is in angularly and laterally displaced position.
Figure 4:
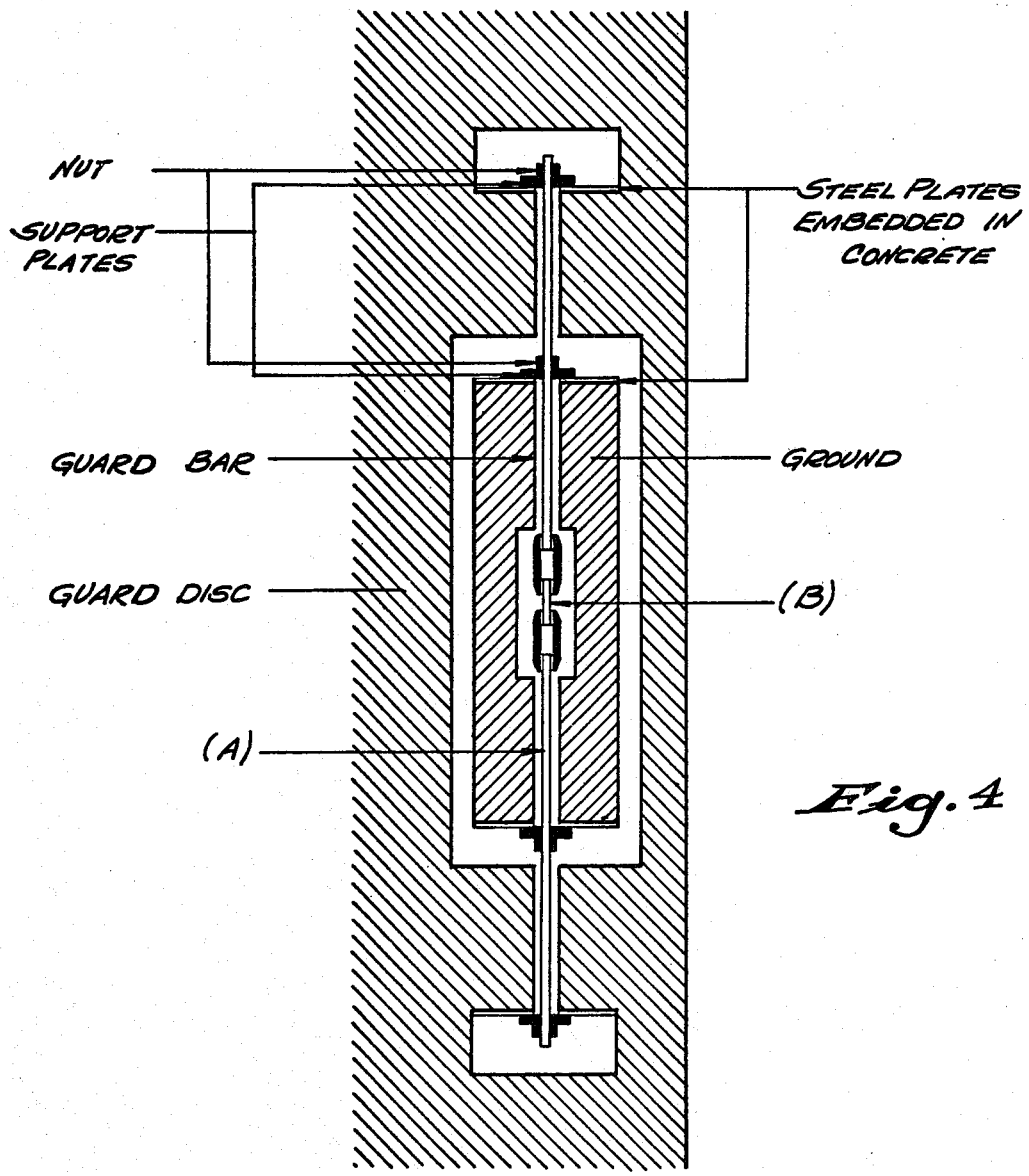
FIG. 4 is a cross-section along lines 4—4 of FIG. 1, showing the rupturable connection between the base plate of a building and the ground.

Referring now to the drawings, specifically to FIG. 4 thereof, the Earthquake Guarding System is described with reference to FIGS. 1 to 4 inclusive. Specifically, the Earthquake Guarding System comprises:

a. Connecting means referred to herein as "Earthquake Guard Bars" (E.B.)

b. Support means, referred to herein as "Earthquake Guard Supports" (E.S.)

c. At least one load distributing base, referred to herein as "Earthquake Guard Disc or Discs" (E.D.) shown in FIG. 1.

More particularly, as shown in FIG. 4, the Earthquake Guard Bars (E.B.) are small steel bars with a middle section of length approximately 10 cm (section B see FIG. 4) which have a sufficiently small diameter to break when the seismic force passing through it exceeds its strength. This bar will be made either with a reduced diameter in its middle, or better, by attaching two sections of bar with greater diameter (sections A see FIG. 4) to either side of a middle section of smaller diameter (section B), these will be joined with special couplings. Through this bar, which is joined to the Earthquake Guard Disc at one end while the other end is anchored in the ground, the force of the wind, acting on the surface of the structure above the ground, is transmitted to the foundation. The horizontal force resulting from the inertia forces distributed through the height of the structure are also transmitted whenever the structure is compelled to participate in the seismic motion of its foundation. When this resultant seismic force becomes greater than the seismic 'resistance' of the bar, the bar is broken and the Earthquake Guard Supports are immediately brought into action.

Figure 1:
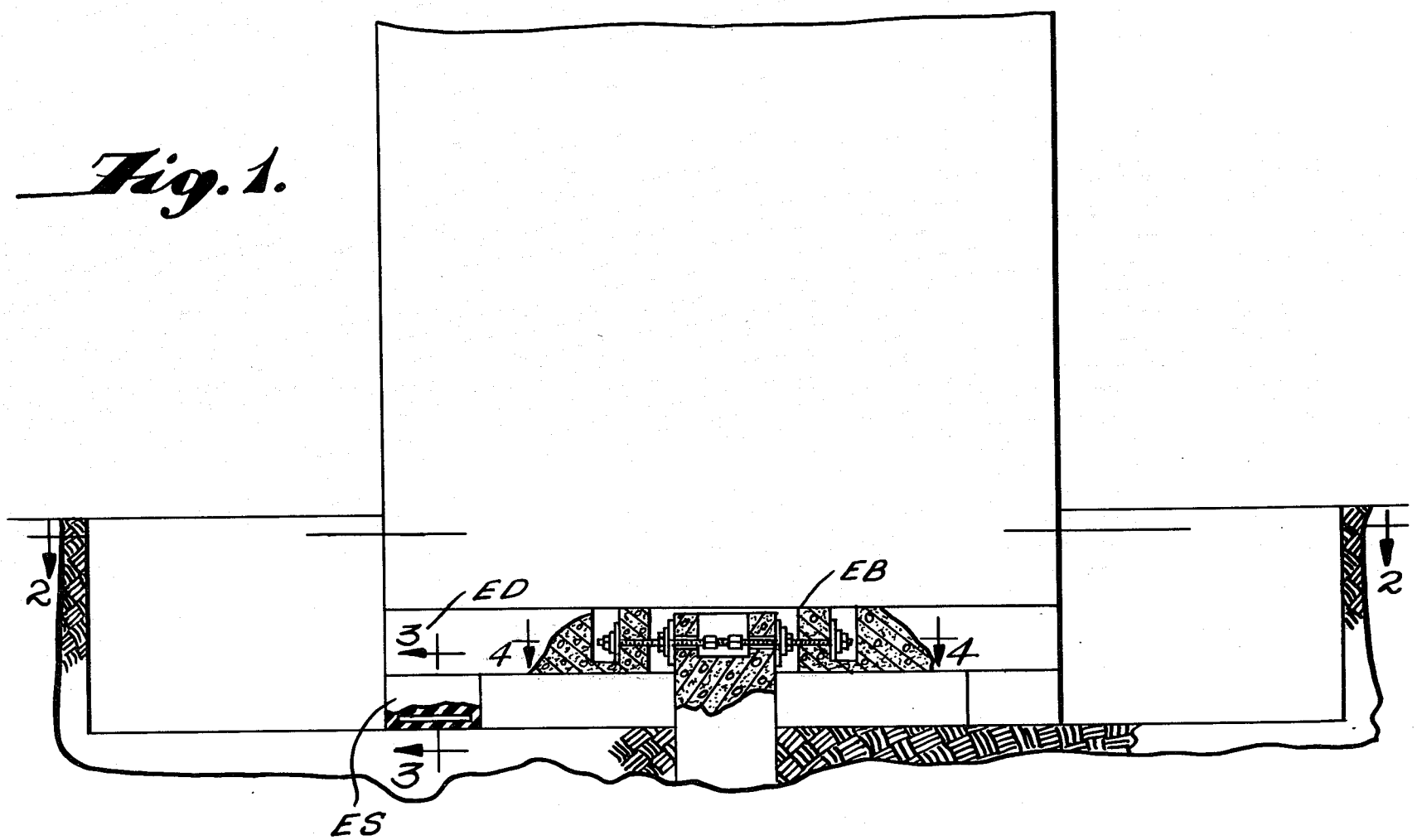
FIG. 1 is an inside elevation of the present invention incorporated in a vertical column positioned to protect the column against excessive seismic transmission.

As shown again in FIG. 1 the support means or Earthquake Guard Supports (E.S.) of rectangular or circular plates (usually known as bearings) of elastomeric synthetic material are provided which transfer to the ground the load of the structure in a first direction, usually the vertical direction. Their thickness varies between 5–20 cm relative to the seismicity of the area. Their length and width, i.e. their surface, is in ratio to the vertical loads which they support. The principle is to use these elastical supports in the same way as shock absorbers in machines. While these supports show an insignificant compression under load at right angles to their surface (in the vertical or first direction) their thickness changes minimally, under horizontal load forces they show great deformations against their elastical resistance in all directions perpendicular to said first direction. Consequently, it can be seen that when the seismic 'fuse' 'burns out', that is when the connecting means, i.e., the Earthquake Guard Bars break, the structure is connected to the ground essentially only by the support means, so that the structure becomes a giant pendulum with the ground moving, whilst the structure remains 'stationary'. More specifically, the structure moves in accordance with its characteristics, while the ground experiences great seismic deformations without endangering the structure at all.

The support means or Earthquake Guard Supports must be so designed that they can safely resist vertical loads and especially when they are horizontally deformed due to the seismic force of the earthquake.

We set out below some details on the Earthquake Guard Supports:

The typical plates which are now generally available have dimensions from 100×150×(14–28) mm up to 600×700×(30–150) mm, or they can be circular in form with dimensions from (diameter) 100×(24–114) mm up to (Diameter) 800×(30–210) mm. These plates are commonly known as bearings.

The choice of width H of the bearings is very significant and especially in our case where the bearings are used as the Earthquake Guard Supports (see FIG. 3). The maximum inclination tgy to which the bearing is allowed to deform is determined by its buckling properties. In the case of deformations which arise from dynamical origin, as with the seismic deformations, the inclination is equal to 0.3 (max. tgy—0.3).

Consequently the maximum allowed horizontal displacement of the top surface of the bearing, which is joined to the structure, in relation to the under surface, which is joined to the ground and therefore follows its seismic move is $$max = 0.3h$$

Because the max must be greater than the maximum anticipated ground oscillation, we can immediately reach the conclusion that the choice of thickness of the bearing is directly dependent, among other things, on the size of oscillation of the expected earthquake.

The height of the bearing is composed of layers of steel plates of width 2mm–5mm alternated with layers of special elastomeric material with width 5mm–15mm proportionate to the thickness H of the bearing. It is made by connecting steel plates with elastomeric material during one stage of production. The elastomeric material completely covers the steel plates and protects them from corrosion.

These bearings, which completely satisfy both statical and dynamical claims, also have the great advantage of a greater life duration or slower fatigue compared with the concrete and steel which usually compose the construction, which is protected from the danger of earthquakes by these bearings etc. The fatigue or ageing process is caused by the corrosive elements of the atmosphere accumulating over the years.

As also shown in FIG. 1, an Earthquake Guard Disc (E.D.) comprising an unusually unique disc provides the horizontal joint for the columns and other vertical elements of the construction, lying exactly above the level of the Earthquake Guard Supports (E.S.).

The function of the E.D. Discs can be seen by studying the following forces which equilibriate on it:

a. the vertical forces from the columns and walls b. the horizontal forces from the columns and walls c. the horizontal forces from the Earthquake Guard Bars d. the vertical and horizontal forces from the Earthquake Guard Supports.

The E.D. is constructed either from reinforced or prestressed concrete, or in the case of a steel construction, from steel profiles. The configuration dimensions, etc. of the E.D. and its statical design of its sufficiency for the above function are not within the purpose of this description. This is not a difficult problem in the sciences of static and of concrete and steel. However it must be emphasized that special attention must be given to ensure safe entrances to the body of the E.D. for all forces which are acting in concentration on small surfaces.

It should be noted that in the case where lifts etc. extend both above and below the level of the disc, it must be taken into account that the disc moves in relation to the 'ground' oscillating horizontally during the earthquake. Thus, such elements as lifts etc. must be elastically joined with the structural framework of the building to avoid damage from the oscillations.

To better understand the construction and function of the connecting means or "Earthquake Guard Bars" (E.B.) and the whole Earthquake Guard System, it is apparent that through the positioning of the Earthquake Guard Bars at four points of the perimeter (see FIGS. 1 and 2) and especially as they are positioned parallel to the periphery (shown in FIG. 4), every horizontal movement of the E.D. in relation to the ground, i.e. movement in a direction perpendicular to the aforesaid first direction or rotation of it on a vertical axis is freely allowed, if the small sections B of the E.B.'s are broken. According to the size of the structure, one or more E.B.'s are located in each of the four points of attachment of the E.D. to the ground.

As seen in FIGS. 1–4, there are holes 101 cut through the load distributing base, i.e. concrete slab or disc 202 to receive the bars and their anchorage to the ground. Each hole 101 has three large areas 102, 103, and 104 connected by narrow passageways 105 and 106. The central enlarged area 103 receives a post 107 which is anchored to the ground below the structure and for present purposes may be regarded as the ground since, under seismic movements it moves with the ground. The post 107 has an enlarged opening 108 at its center and two narrow passages 109 and 110 which are aligned with the passageways 105 and 106 so that the bar 210 may extend from the enlarged opening 104, through the respective passageways in the disc 202 and the post 107 to the enlarged opening 102. The bar 210 is assembled from two long, large diameter bars 111 and 112 and a short, smaller diameter bar 113, coupled by connectors 114 and 115. Nuts 116, 117, 118 and 119 are secured on the large diameter rods, at the ends of passageways 109 and 110 of the post 107 and at the outer ends of passageways 105 and 106 in the disc 202 which are tightened against support plates. The surfaces of the disc 202 and the post 107 against which these support plates are positioned are reinforced with steel plates 120, 121, 122 and 123. The arrangement of the nuts is such that the bar 210 always is in tension until it breaks and the structure is restrained against movement relative to the ground in the direction of the bar. However, under great seismic forces in that direction, the short rod 113 will break after the short rod 113 is subjected to a tension force of predetermined magnitude, i.e. the tensile strength of rod 113. At that point, the building has moved only to the extent of the elongation of rod 113 which is much less than the movement allowed by the space between the post 107 and the concrete slab or disc 202. As shown in the drawing, there is a peripheral clearance of corresponding extent around the structure allowing movement of the structure in all of the aforesaid perpendicular directions to the same extent after rod 113 has broken.

Figure 2:
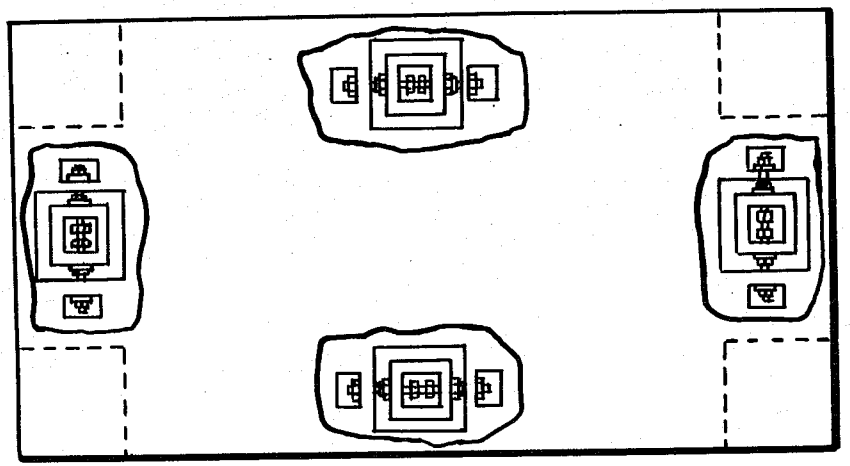
FIG. 2 is a plan view of the base taken along lines 2—2 of FIG. 1. It will be seen that the spaces above the rods must remain accessible in order to make it possible to exchange the sleeve or the intermediate elements which are of smaller diameter.

As shown in FIG. 2, the connecting means comprises two groups of tension elements, i.e. bars 210. The tension elements in each group are parallel to each other and the groups are perpendicular to each other. As also shown in FIG. 2, those tension elements are disposed circumferentially around the load distributing base, the tension elements of each group being on opposite sides of the load distributing base from each other.

After they are broken the E.B.'s have no further function. A small reserve of section B bars will be kept wherever the system is installed to replace the broken section. This will be the only damage from the earthquake. This means damage costing only a few dollars instead of the hundred of millions of dollars which would otherwise be lost through, for example, the total destruction of a skyscraper.

When the seismic inertia forces passing through the E.B.'s increase past the maximum permitted level, one set of them will break. Immediately after the set on the opposite side will also break, and depending on the circumstances the breakage of the two other sets of E.B.'s may follow shortly.

The plates of the E.B.'s (FIG. 4) bring the bar in contact with the ground through other similar plates 120, 121, 122 and 123 which are securely connected with the concrete. In this way the concrete is sufficiently reinforced to withstand the forces from the E.B.'s and at the same time the E.D. which is usually of large dimensions, is able to contract and expand from change of temperature, etc. without hindrance. As a result, the E.D. can deform as necessary without experiencing stress. Thus the lateral clearance between bars 111, 112 and the walls of the passages 105, 106, 109 and 110 allow for expansion and contraction because of changes in temperature, in a direction perpendicular to the direction of tension of the bar 210. If one connects the direction in which such expansion and contraction is allowed by the respective bars in the locations shown in FIG. 2, they will be seen to meet at a point so that expansion and contraction because of temperature is allowed in all directions perpendicular to the load of the structure, i.e., in all of the aforesaid "perpendicular directions." Neither do these deformations cause considerable stress to the E.S., due to their great flexibility in the case of horizontal deformation. Finally the nuts of the E.B. are tightened by hand or the E.B.'s are stressed minimally with a press.

If necessary (for the protection of the E.S. from the risk of distortion beyond the permitted limits) other bars, similar to E.B.'s, can be placed in exactly the same way as the E.B.'s and they will allow movement of the E.D. in relation to the ground only until the maximum permitted level is reached. This means they will show clearance of, for example, $\pm 5$ cm (in this case 5 cm, plus the magnitude of the elastical deformation of these bars, will be the maximum displacement which can be followed by the E.S.). These other bars will consist of only one section of large diameter. Their influence on the construction can easily be taken into account by the design.

In the description of the Earthquake Guarding System epitomizing the invention, the expression E.B. we do not necessarily mean that in all cases this must be a 'bar' as it may be another suitable structural element such as a spring, hydraulic press or elastic of a complete form etc. provided it combines the necessary components in such a way as to satisfy the requirements of the Earthquake Guarding System as set out in the previous description. In particular the 'bar' must join the structure with the ground in such a way that, while the forces from the wind are safely transferred to the ground, in the case of an earthquake where the forces exceed a given value (this value to be determined by the designer of the construction), this joint, referred to above, will be disconnected. After the disconnection the horizontal and vertical forces which are acting on the construction will be transferred totally through the E.S. The formation of these 'bars' must be of such a configuration that they do not react against all the other statical etc. requirements of the structure e.g. they must be allowed expansion and contraction due to temperature etc.

The same is valid for the E.S. These can, of course, be made from elastic bearings as in our example, but they can also be made from bearings of other materials such as roller bearings, teflon, etc. combined with elastic bearings or springs, or they can be of a structure completely different from bearings provided they satisfy the functional requirements of the E.S. as set out in the previous description. In particular these 'supports' must be in a position to safely transport to the ground both the vertical loads and (in the case of the fracture of the E.B.) also the horizontal loads. At the same time they must have a small stiffness and be sufficiently flexible to be able to follow safely the seismic movements of the ground without transferring great horizontal seismic forces from the ground to the structure.

The E.D. need not necessarily be disc-shaped, but may be of any structural shape which can satisfactorily join the construction with the ground through the E.S. and E.B.'s.

Although the illustrative embodiments of the invention have been described in considerable detail for the purpose of fully disclosing a practical operative structure by means of which the invention may be practiced, it is to be understood that the particular apparatus described herein are intended to be illustrative only and the various novel characteristics may be incorporated in other structural forms without departing from the invention as defined in the subjoined claims. The invention having now been fully explained what I claim is set forth in the appended claims.

What I claim is:

1. A structure having a superstructure and at least one load distributing base supporting said superstructure, the connections between said structure and the earth being essentially a support means and a connecting means said support means transferring to the ground the load of the structure in a first direction from said load distributing base, said support means comprising elastic means joined to said structure and joined to the ground which provides elastic resistance to movement of the structure in all directions perpendicular to said first direction so that said support means is able to follow dynamic movements of the ground in said perpendicular directions without transferring great forces from the ground to said base in said perpendicular directions, said structure being provided with peripheral clearance from the ground in said perpendicular directions so that said base can move a predetermined distance through said clearance relative to the ground in said perpendicular directions, said connecting means being connected respectively to said base and to the ground in a said perpendicular direction, said connecting means being sufficiently strong to substantially prevent movement of said structure under forces in said perpendicular directions less than a predetermined magnitude but sufficiently weak to abruptly disconnect the connection between the ground and the base immediately upon being subject to a force of said predetermined magnitude when said base has moved a small proportion of said predetermined distance in said perpendicular direction, thereby removing the restraint against movement of the structure in said perpendicular direction by removing the transmission of forces in said perpendicular direction through said connecting means so that the load of said structure remains supported on said support means which thereafter provides the only essential connection to the ground, said support means having sufficient elastic stiffness in said perpendicular direction to apply restoring forces to said structure and to safely transfer loads in said perpendicular direction from the structure to the ground, after said connecting means has disconnected, thereby permitting the structure to move relative to the ground in said perpendicular direction through said peripheral clearance against the elastic resistance of said support means and in accordance with abruptly changed dynamic characteristics and to withstand said dynamic movements of the ground.

2. A structure as set forth in claim 1 in which said connecting means comprises a plurality of connecting elements.

3. A structure as set forth in claim 2 in which each of said connecting elements is a tension element which is held in tension between said base and the ground at all times until it disconnects.

4. A structure as set forth in claim 3 in which said tension element disconnects by breaking upon being subjected to a tension greater than said force of predetermined magnitude.

5. A structure as set forth in claim 4 in which each said tension element substantially prevents movement of said structure in the direction of tension prior to disconnecting, but permits movement in another said perpendicular direction which is perpendicular to said direction of tension whereby thermal expansion and contraction of said load distributing base is permitted in a direction perpendicular to said direction of tension.

6. A structure as set forth in claim 5 in which said other perpendicular directions, which are perpendicular to the directions of tension of the respctive tension elements, meet at a point whereby said load distributing base is free for thermal expansion and contraction in all said perpendicular directions.

7. A structure as set forth in claim 6 in which there are two groups of said tension elements, the directions of tension of said elements in each group being parallel to each other and the directions of tension of the respective groups being perpendicular to each other.

8. A structure as set forth in claim 7 in which said elements are disposed circumferentially at four locations, the tension elements of each group being disposed on opposite sides of said load distributing base from each other.

9. A structure as set forth in claim 4 in which each said tension element is connected with said base at two end points and with the ground at two intermediate points, so that when said structure moves either way along its direction of tension, tension is imparted to said element between one said intermediate point and the said end point which is furthest from said intermediate point.

10. A structure as set forth in claim 9 in which said tension elements are rods connected with said base and the ground by nuts and plates which plates slide against the ground and said base.

11. A structure as set forth in claim 9 in which each said tension element is a bar having two portions of larger cross-sectional area and a portion of smaller cross-sectional area comprising at least a portion of the extent of said bar between said intermediate points, whereby said portion of small cross-sectional area is ruptured preferentially upon being subjected to a tension greater than said predetermined force.

12. A structure as set forth in claim 11 in which each said tension element is constructed from two rods, which are joined, at a location between said two intermediate points, by a third rod of smaller crosssectiona, the rod of smaller cross-section being exchangeable without replacing said two rods, said rod of smaller cross-section being ruptured preferentially upon being subjected to a tension greater than said predetermined force.

13. A structure as set forth in claim 1 in which said support means comprise elastomeric bearings.

14. A structure as set forth in claim 1 in which said support means includes springs connected to said structure and to the ground to provide elastic resistance.

15. A structure as set forth in claim 1 including displacement guards to limit the movement of the structure in said perpendicular direction after said connecting means become disconnected.

16. A structure as set forth in claim 1 in which said support means comprises an elastomeric bearing which supports part of the weight of the structure and also teflon bearings which support part of the weight of the structure.

17. A structure as set forth in claim 1 in which said support means includes springs which provide elastic resistance.

18. A structure having a superstructure and at least one load distributing base supporting said superstructure, support means to transfer to the ground the load of the structure in a first direction from said load distributing base, said support means providing elastic resistance to movement of the structure in all directions perpendicular to said first direction so that said means is able to follow dynamic movements of the ground in said perpendicular directions without transferring great forces from the ground to said base in said perpendicular directions, said structure being provided with peripheral clearance from the ground in said perpendicular directions so that said base can move a predetermined distance through said clearance relative to the ground in said perpendicular directions, connecting means connected respectively to said base and to the ground in a said perpendicular direction, said connecting means being sufficiently strong to substantially prevent movement of said structure under forces in said perpendicular directions less than a predetermined magnitude but sufficiently weak to abruptly disconnect the connection between the ground and the base immediately upon being subject to a force of said predetermined magnitude when said base has moved a small proportion of said predetermined distance in said perpendicular direction, thereby removing the restraint against movement of the structure in said perpendicular direction by removing the transmission of forces in said perpendicular direction through said connecting means while the structure remains supported by said support means, said support means having sufficient elastic stiffness in said perpendicular direction to apply restoring forces to said structure and to safely transfer loads in said perpendicular direction from the structure to the ground, after said connecting means has disconnected, thereby permitting the structure to move relative to the ground in said perpendicular direction through said peripheral clearance against the elastic resistance of said support means and in accordance with abruptly changed dynamic characteristics and to withstand said dynamic movements of the ground, said connecting means comprising two groups of connecting elements constructed and arranged to transfer forces from said base to the ground respectively perpendicular to each other and perpendicular to said first direction and each said connecting element permitting movement of said base perpendicular to the direction in which it transfers forces, said groups of said connecting elements being disposed circumferentially at four oppositely disposed locations and comprising two groups of breakable tension elements, the tension elements in each group being parallel to each other and the respective groups being perpendicular to each other, each tension element being secured both to the ground and to said base, said tension elements rupturing when subjected to said forces of predetermined magnitude, the tension elements being rods each of which resists movement of said base in both directions along said rod, said tension elements being steel rods of predetermined strength which are joined to steel rods of smaller cross section, the steel rods of smaller cross section being exchangeable and said base being a plate having recesses, and including foundation elements having projections extending into said recesses, said rods being arranged in channels in the plane of said base parallel to the outer edges of said base with lateral play and fixed by means of anchorages relative to said base and relative to said projections, but movable in the direction transverse to their longitudinal axis, and where said projection has a recess accommodating the breakable part of the tension elements to facilitate replacement when said breakable element has been broken.

19. Apparatus for isolating a superstructure from its foundation to prevent damage to the superstructure from horizontal forces acting between the superstructure and the foundation comprising: means comprising an elastomeric bearing for transferring the superstructure weight to the foundation, the weight transferring means permitting substantial relative horizontal movements between the superstructure and the foundation under the influence of minor horizontal forces but offering elastic resistance to forces produced by such movement, and connecting means independent of the weight-transferring means for the transmission of horizontal forces between the superstructure and the foundation, said connecting means substantially preventing horizontal movements between the superstructure and the foundation when subjected to a horizontal force of up to a predetermined magnitude and permitting free horizontal movements between the superstructure and the foundation when the horizontal force exceeds the predetermined magnitude so that the force exerted by the connecting means during substantial relative movement of the superstructure is substantially zero.

20. Apparatus as set forth in claim 19 in which said means for transferring the superstructure weight to the foundation comprises an elstomeric bearing and also polytetrafluoroethylene bearings.

* * * * *